US007100777B1

(12) United States Patent
Kao

(10) Patent No.: US 7,100,777 B1
(45) Date of Patent: Sep. 5, 2006

(54) HANGER RACK FOR HAND TOOLS

(76) Inventor: Jui-Chien Kao, No. 358, Tunghsing Rd., Shuwang Li, Tali City, Taichung Hsien (TW)

( * ) Notice: Subject to any disclaimer, the term of this patent is extended or adjusted under 35 U.S.C. 154(b) by 0 days.

(21) Appl. No.: 11/175,162

(22) Filed: Jul. 7, 2005

(51) Int. Cl.
*A47F 7/00* (2006.01)

(52) U.S. Cl. ..... 211/70.6; 211/4; 211/60.1; 206/372; 206/464

(58) Field of Classification Search ..... 211/70.6, 211/60.1, 69, 90.04, 86.01, 17, 4; 206/806, 206/807, 349, 96, 211, 443, 379, 378, 346, 206/372, 376, 464, 471, 495; 248/274.1, 248/226; 312/234, 137, 354, 349; D8/71, D8/349, 330
See application file for complete search history.

(56) References Cited

U.S. PATENT DOCUMENTS 1,681,107 A * 8/1928 Fegley et al. ..... 248/158
4,467,925 A * 8/1984 Ratzloff et al. ..... 211/70.6
4,586,615 A * 5/1986 Quitmann ..... 211/70.6
6,092,655 A * 7/2000 Ernst ..... 206/378
6,092,656 A * 7/2000 Ernst ..... 206/378
6,131,740 A * 10/2000 Huang ..... 206/759
6,386,363 B1 * 5/2002 Huang ..... 206/378
6,450,338 B1 * 9/2002 Chen ..... 206/378
6,834,767 B1 * 12/2004 Lin ..... 211/70.6

* cited by examiner

*Primary Examiner*—Richard E. Chilcot, Jr.
*Assistant Examiner*—Lindsay M. Maguire
(74) *Attorney, Agent, or Firm*—Rabin & Berdo, P.C.

(57) ABSTRACT

A hanger rack for hand tools includes a bar having a rail formed at an upper side of the bar. Multiple fixture pieces are movably mounted on the bar. Each fixture piece has a seat with a hook slidably attached to the rail and a hanging member laterally extending from the seat for attaching with a hand tool. Whereby, the fixture pieces are slidable along the bar, spaces between two adjacent fixture pieces can be adjusted according to the sizes of the hand tools such as screwdrivers.

2 Claims, 8 Drawing Sheets

HANGER RACK FOR HAND TOOLS

BACKGROUND OF THE INVENTION

1. Field of the Invention

The present invention relates to a hanger rack for hand tools, and more particularly to a hanger rack of which fixture pieces can be adjusted according to sizes of hand tools.

2. Description of Related Art

A conventional hanger rack for hand tools generally includes a bar and multiple fixture pieces. However, the fixture pieces are securely mounted on the bar and spaces between the fixture pieces cannot be adjusted according to sizes of hand tools.

Therefore, the invention provides a hanger rack for hand tools to mitigate or obviate the aforementioned problems.

SUMMARY OF THE INVENTION

The main objective of the present invention is to provide a hanger rack of which fixture pieces are adjustable according to sizes of hand tools.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
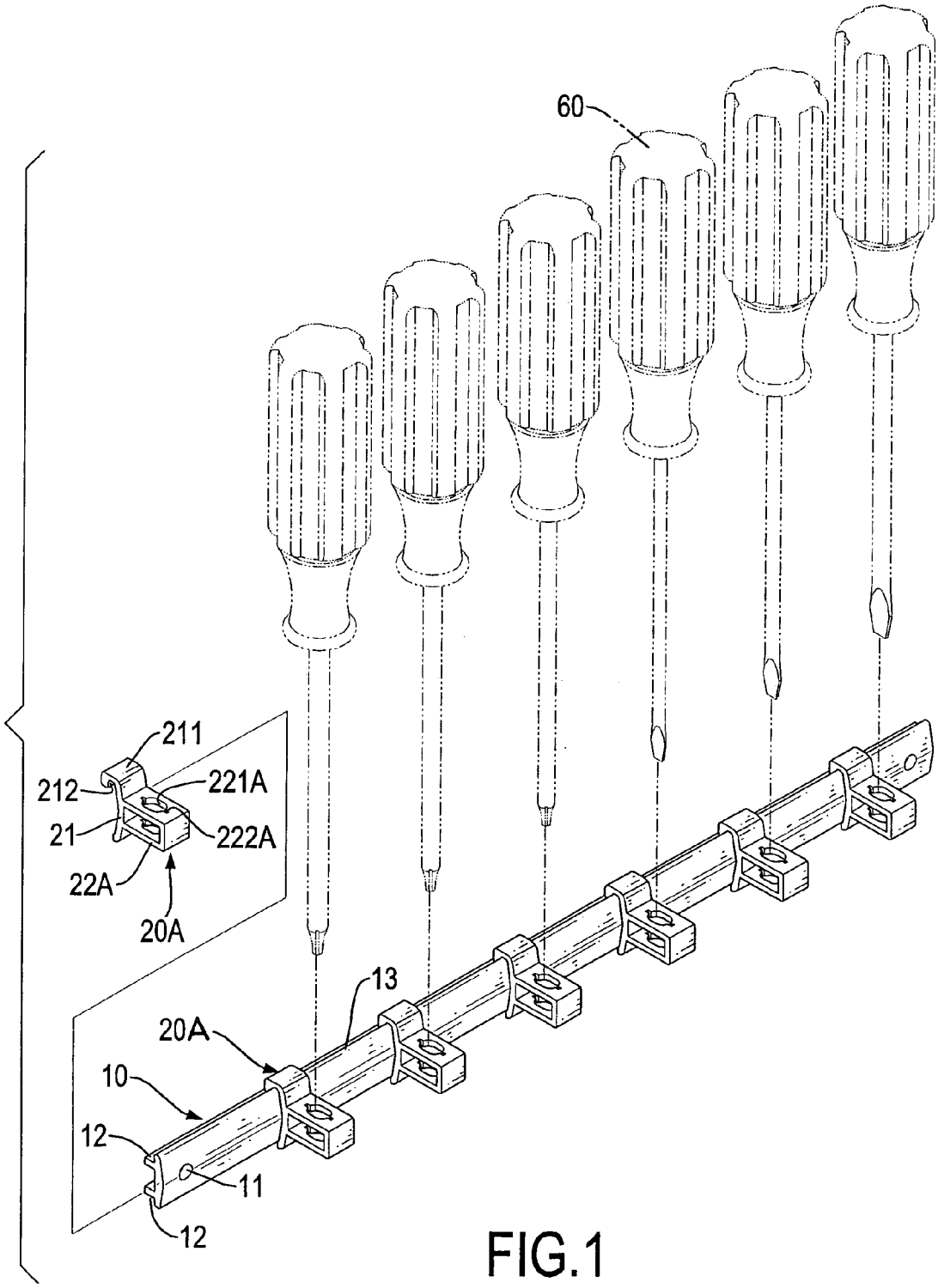
FIG. 1 is a perspective view of a hanger rack for hand tools in accordance with the present invention.
Figure 2:
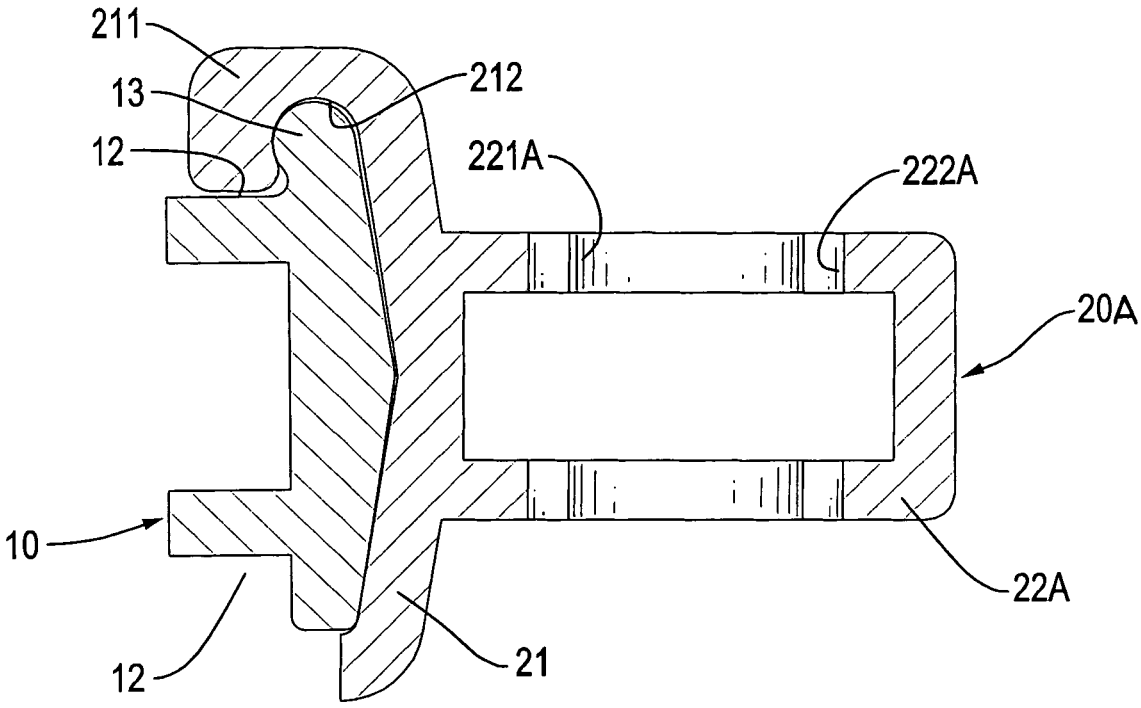
FIG. 2 is a cross sectional view of the hanger rack in FIG. 1.
Figure 3:
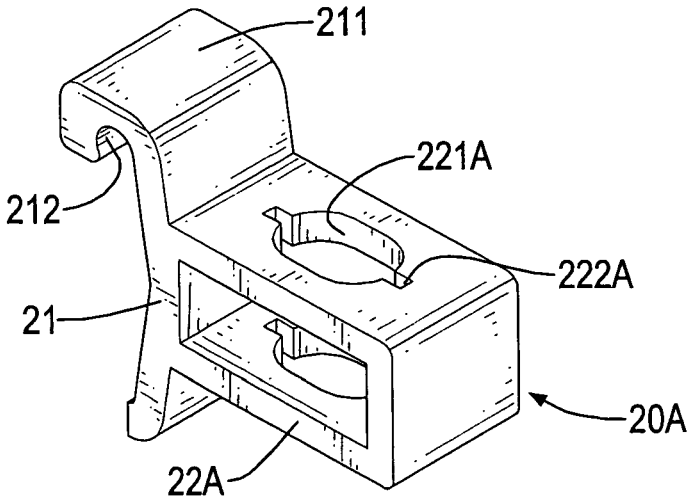
FIG. 3 is a perspective view of a fixture piece of the hanger rack.

With reference to FIGS. 1–3, a hanger rack in accordance with the present invention has a bar (10) and multiple fixture pieces (20A) movably provided on the bar (10). The bar (10) has a substantially π-like cross section rotated 90 degrees in that a longitudinal strip has a front face and a rear face, with two parallel legs extending perpendicularly along the longitudinal strip and on the rear face. Two parallel channels (12) are respectively defined in an upper face and lower face of the legs. A longitudinal ridge is formed at a front face of the longitudinal strip. A rail (13) with a round edge is formed at an upper side of the bar (10). Two fastening members are respectively formed at two ends of the bar (10). In a preferred embodiment, the fastening members are two holes (11) respectively defined at two ends of the bar (10) for installing the bar (10) by fasteners being extended through the holes (11) and into a support surface such as a wall (not shown).

Referring to FIG. 3, the fixture pieces (20A), six in this embodiment, each have a seat (21) and a hanging member (22A) laterally extending from the seat (21) for receiving a hand tool. The seat (21) has a substantially inverted J-like end to correspond the bar (10) and has a hook (211) extending perpendicularly from the end with a guide channel (212) being defined in the hook (211). The fixture piece (20A) is slidably mounted the bar (10) via mating the guide channel (212) with the rail (13).

In this embodiment, the hanging member (22A) is formed as a quadrate ring with an upper board and a lower board. Two openings (221A) are respectively defined through the upper board and lower board and aligned with each other. Each of the openings (221A) has two notches (222A) respectively defined at two diametrically opposite sides of the opening (221A). Thus, a shank of a screwdriver (60) can be positioned in the respective opening (221A). Alternatively, those skilled in the art will understand that the hanging member can be formed as a block with an opening defined through the hanging member.

Because the fixture pieces (20A) are slidable along the bar (10), spaces between two adjacent fixture pieces (20A) can be adjusted according to the sizes of the hand tools such as screwdrivers (60).

Figure 4:
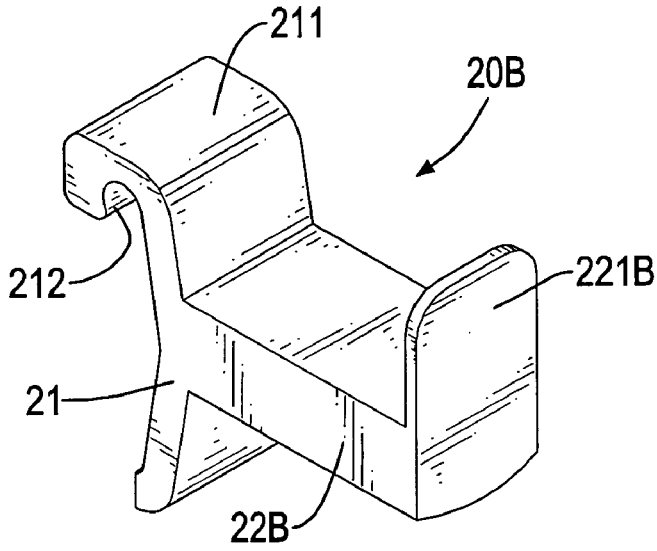
FIG. 4 is a perspective view of a second fixture piece.
Figure 6:
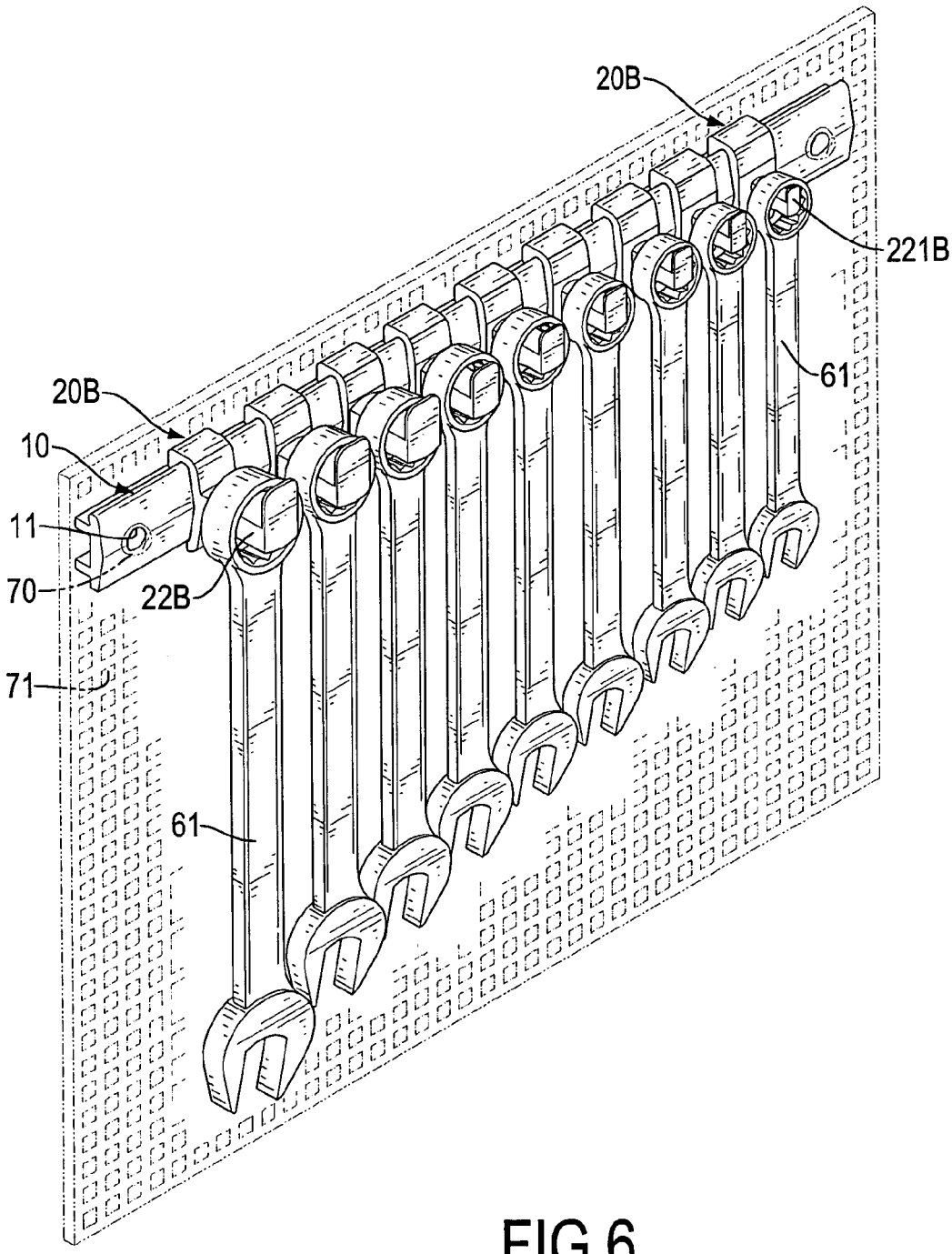
FIG. 6 is a perspective view of the hanger rack with the second fixture piece for hanging wrenches.

With reference to FIGS. 4 and 6, the hanger rack can be provided with second fixture pieces (20B) for hanging wrenches (61). The second fixture pieces (20B) each have a seat (21) the same as that of the first fixture piece (20A), but also have a finger (22B) laterally extending from the seat (21) and a stop (221B) uprightly formed at a free end of the finger (22B).

Figure 5:
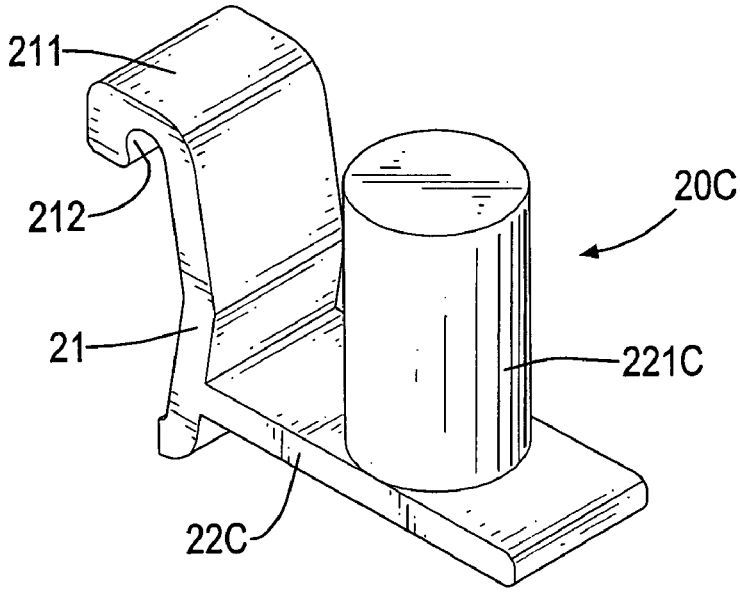
FIG. 5 is a perspective view of a third fixture piece.
Figure 7:
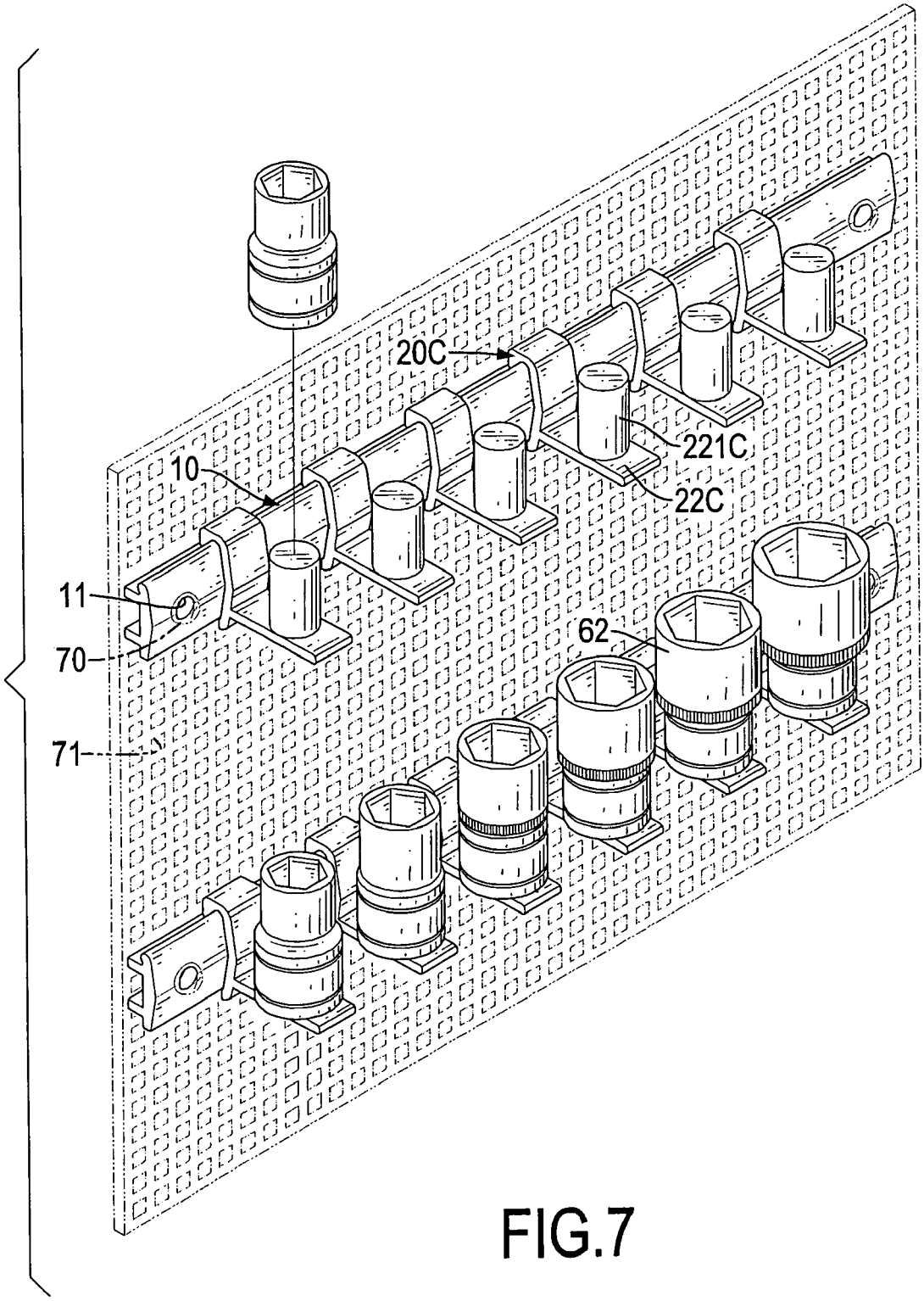
FIG. 7 is a perspective view of the hanger rack with the third fixture piece for hanging socket wrenches.

With reference to FIGS. 5 and 7, the hanger rack can be provided with third fixture pieces (20C) for mounting socket wrenches (62) thereon. The third fixture pieces (20C) each have a seat (21) the same as that of the first fixture piece (20A), a finger (22C) laterally extending from the seat (21) and a positioning pole (221C) erected from the finger (22C).

With reference back to FIG. 1, the screwdrivers (60) are respectively hung on the fixture pieces (20A) by inserting the shanks through the openings (221A). For a shank with a flat end, the flat end is aligned with the notches (222A) so as to insert the shank through the opening (221A). Thereafter, the screwdriver (60) is turned with a certain angle to prevent the screwdriver (60) from easily escaping the opening (221A) or from being quickly removed by a thief.

With reference to FIGS. 4–7, the bar (10) is secured on a board (71) with multiple apertures by fasteners (70) inserted through the holes (11) and the apertures. Then, the wrenches (61) and socket wrenches (62) can be hung on the fixture pieces (20B, 20C). The board (71) enables one or more of the bars (10) to be attached thereto without having to drill many holes as would be necessary if the bars were simply mounted to a wall.

Figure 8:
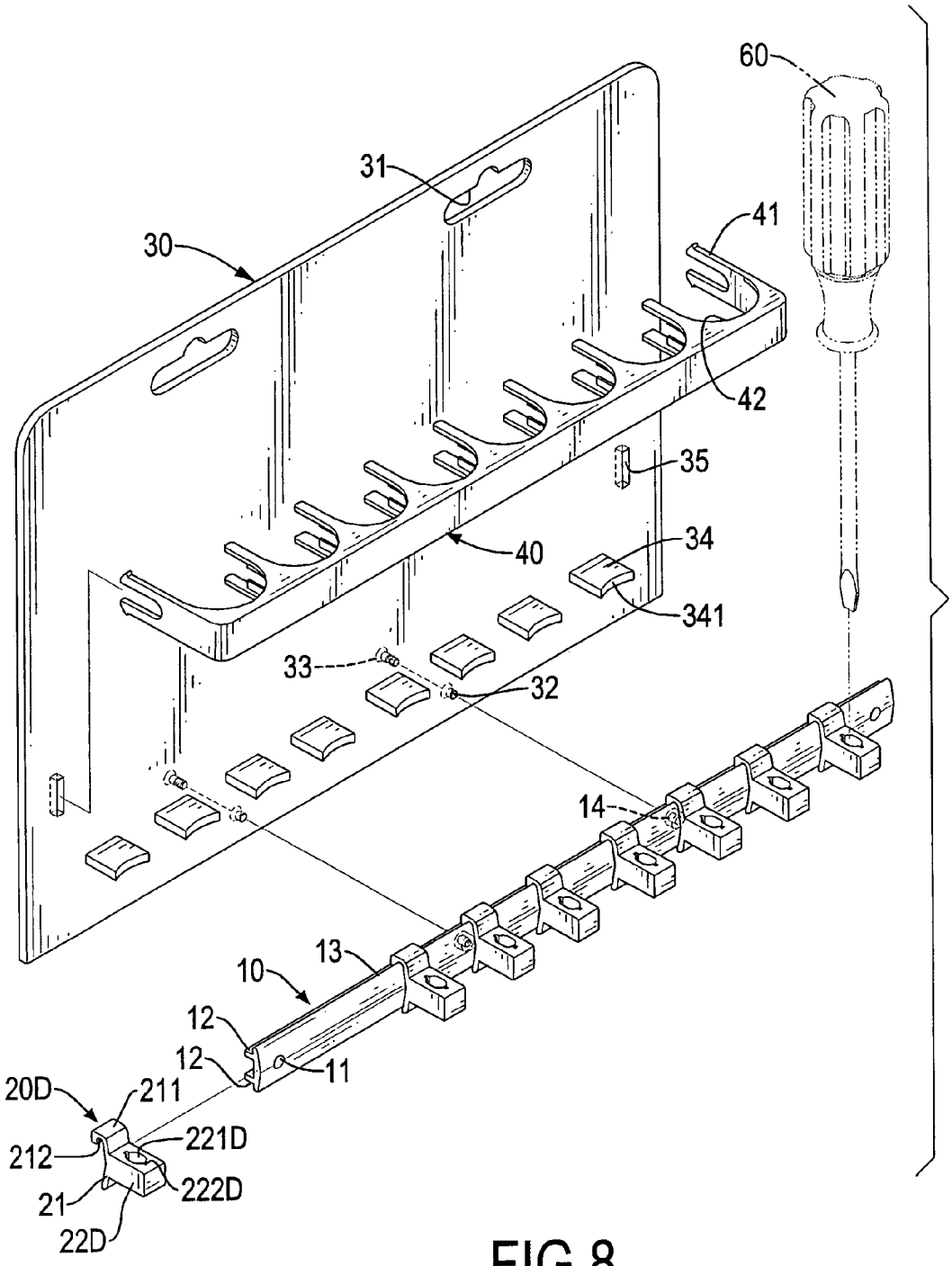
FIG. 8 is an exploded perspective view of the hanger rack.
Figure 9:
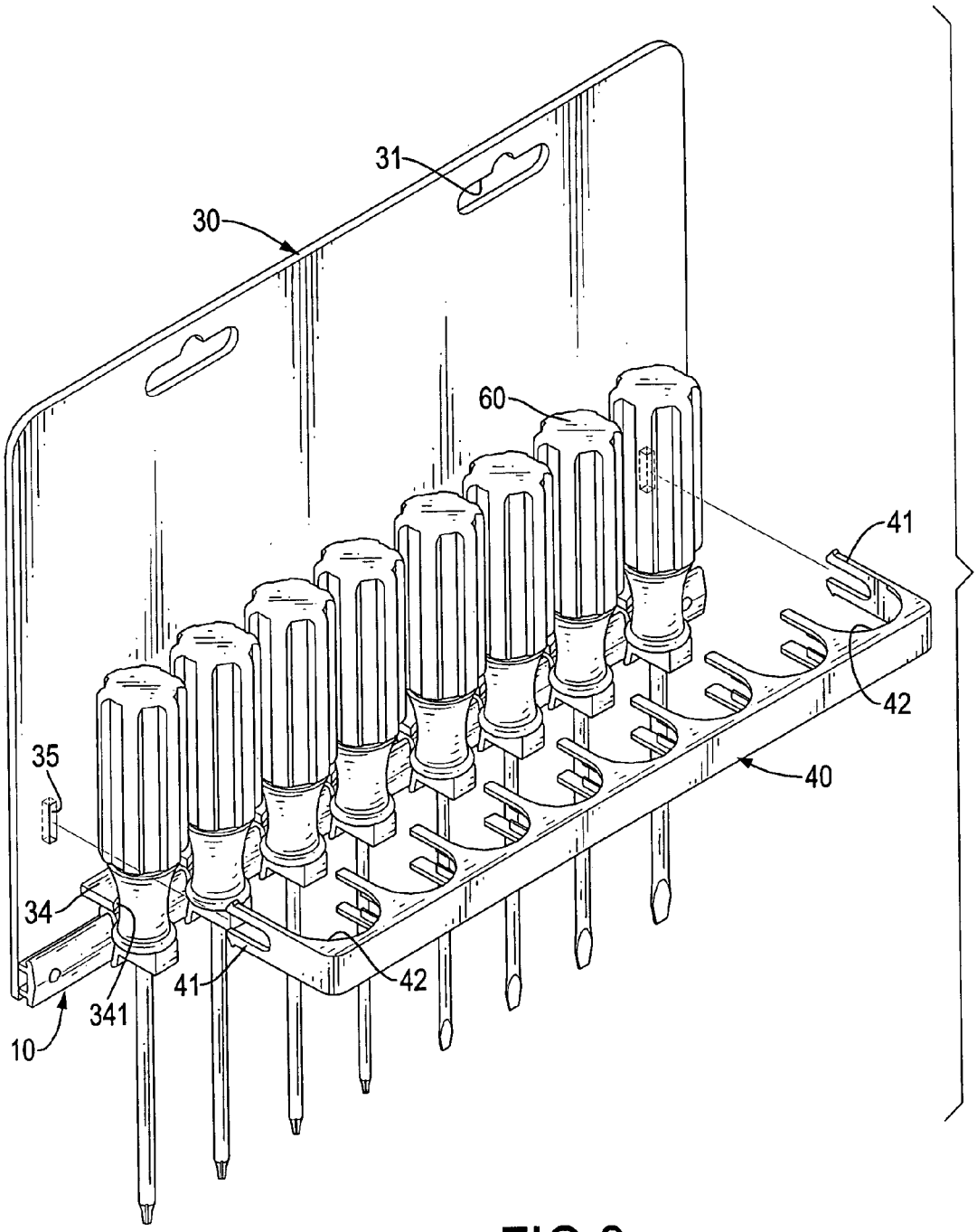
FIG. 9 is an exploded perspective view of the hanger rack with screwdrivers.
Figure 10:
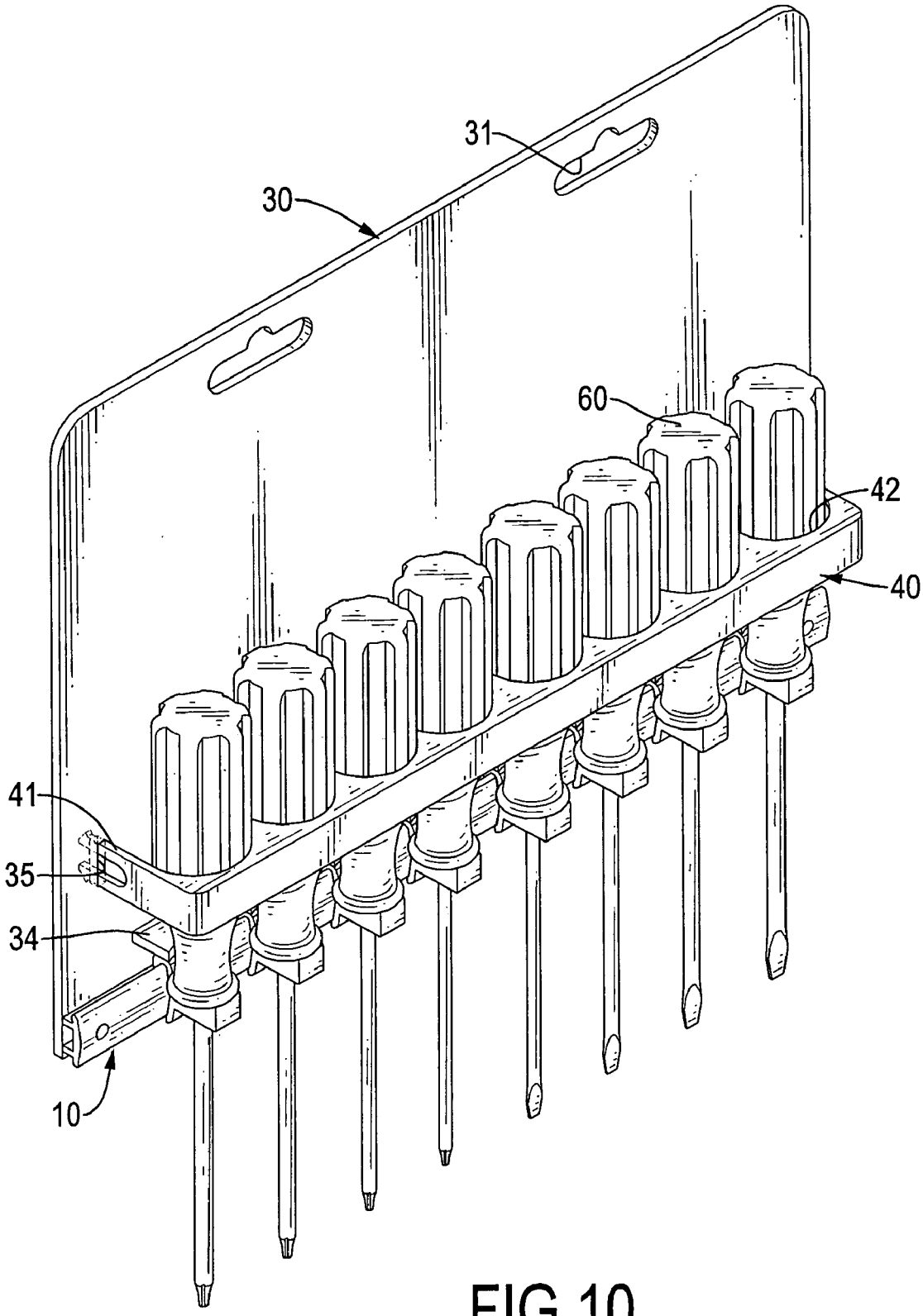
FIG. 10 is a perspective view of the hanger rack in FIG. 9.

With reference to FIGS. 8–10, the hanger rack can be used in a package for the hand tools.

The hanger rack has two threaded holes (14) which are defined between the holes (11). Multiple fixture pieces (20D) are movably mounted on the bar (10). Each of the fixture pieces has a seat (21) and a hanging member (22D) laterally extending from the seat (21) for receiving a hand tool. The hanging member (20D) is formed as a block with an opening defined through the hanging member.

A sheet (30) has at least one hanging slot (31) defined at an upper portion. Two screw holes (32) are defined through the sheet (30) and aligned with the threaded holes (14). Two screws (33) are respectively inserted through screw holes (32) and engaged in the threaded holes (14) to fasten the bar (10) on the sheet (30).

Multiple tongues (34) are formed on the sheet (30) to correspond to the fixture pieces (20D). Each of the tongues (34) has a concave free end (341). Two elongated slots (35) are respectively defined at two sides of the sheet (30) and above the tongues (34).

A fastening strip (40) includes two locking arms (41) respectively formed at two ends thereof and respectively engaged in the elongated slots (35). Multiple U-like recesses (42) are defined between the locking arms (41) and correspond to the tongues (34) and fixture pieces (20D).

The screwdrivers (60) can be displayed on the hanger rack, as illustrated in FIGS. 9 and 10. The screwdrivers (60) are inserted into the openings (221D) as described above and necks (not numbered) of the screwdrivers (60) respectively abut the tongues (34). Then, the fastening strip (40) is assembled on the sheet (30) to locate handles of the screwdriver (60) in the recesses (42). Therefore, the screwdrivers (60) are fixed on the sheet (30) and can not be easily removed, such that thieves are deterred.

For removing the screwdrivers (60), the fastening strip (40) is detached from the sheet (30) and the screwdrivers (60) can be removed.

The bar (10) also can be removed from the sheet (30) by releasing the screws (33) and directly installed on the board (70) as mentioned hereinbefore.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A hanger rack for hand tools comprising:

a bar (10) having a rail (13) formed at an upper side of the bar (10) and two fastening members respectively formed at two ends of the bar (10);

multiple fixture pieces movably mounted on the bar (10), each fixture piece having a seat (21) with a hook arm (211) slidably attached to the rail (13), and a hanging member laterally extending from the seat (21) for attaching with a hand tool;

a sheet (30) on which the bar (10) is detachably mounted, the sheet (30) having at least one hanging slot (31) defined at an upper portion, multiple tongues (34) formed on the sheet and above the bar (10); and two elongated slots (35) respectively defined at two sides of the sheet (30); and a fastening strip (40) having two locking arms (41) respectively formed at two ends of the fastening strip (40) and respectively engaged in the elongated slots (35), and multiple U-shaped recesses (42) defined between the locking arms (41) and corresponding to the tongues (34) and fixture pieces (20D).

2. The hanger rack as claimed in claim 1, wherein the hanging member (22A) is formed as a block and has an opening (221A) defined through the block and two notches (222A) respectively defined at two diametrically opposite sides of the opening (221A).

* * * * *